US005415211A

United States Patent [19]

Susnjara et al.

[11] Patent Number: 5,415,211

[45] Date of Patent: May 16, 1995

[54] APPARATUS FOR PRODUCING SQUARE INSIDE CORNERS ON A WORKPIECE

[75] Inventors: Kenneth J. Susnjara, Santa Claus; Michael P. Hardesty, Dale, both of Ind.

[73] Assignee: Thermwood Corporation, Dale, Ind.

[21] Appl. No.: 138,595

[22] Filed: Oct. 15, 1993

[51] Int. Cl.[6] ..... B27C 5/00

[52] U.S. Cl. ..... 144/147; 83/875; 83/628; 144/134 R; 144/136 R; 144/371; 144/2 R

[58] Field of Search ..... 83/861, 862, 875, 628; 144/2 R, 3 R, 136 R, 147, 148, 134 R, 368, 371; 74/25, 27, 39, 49, 50, 55, 56

[56] References Cited

U.S. PATENT DOCUMENTS

| | | | |
|---|---|---|---|
| 241,316 | 5/1881 | Dietrich | 144/147 |
| 387,389 | 9/1888 | Batt | 144/147 |
| 443,806 | 12/1890 | Vance | 144/147 |
| 514,053 | 2/1894 | Anlvin | 144/147 |
| 519,035 | 5/1894 | Cristadoro | 144/147 |
| 616,002 | 12/1898 | Marles | 144/147 |
| 4,932,450 | 6/1990 | Baker . | |

*Primary Examiner*—W. Donald Bray
*Attorney, Agent, or Firm*—Lalos & Keegan

[57] ABSTRACT

An apparatus for machining a square inside corner on a workpiece. The apparatus comprises a rotatable shaft, a device cooperating with the shaft for transferring the rotating motion of the shaft to transverse oscillating motion, and a cutting tool mounted to the device and moving in the transverse oscillating motion. The cutting tool preferably includes a blade contoured to produce the desired cutting surface. Both edges of the blade are cutting edges and are disposed at a 45° angle. The device comprises a pin mounted on and offset from the shaft, a sliding plate to which the cutting tool is mounted, and a pair of sliding sleeves on either side of the sliding plate. The sliding plate includes an elongated slot to receiving the pin so that as the shaft rotates, the pin is moved within the slot causing the sliding plate to slide transversely within the sliding sleeves to provide the transverse oscillating motion.

11 Claims, 2 Drawing Sheets

APPARATUS FOR PRODUCING SQUARE INSIDE CORNERS ON A WORKPIECE

BACKGROUND OF THE INVENTION

The invention relates to an apparatus for manufacturing square inside corners on the face of a workpiece; and, more particularly, to an apparatus for making square inside corners for simulated raised panel doors as used on furniture and kitchen cabinets.

The prior art conventional raised panel door is shown in FIGS. 1 and 2. The conventional door consists of a center panel 1 and four frame parts 2, 3, 4 and 5. As shown in FIG. 2, the panel fits into a U-shaped groove, commonly referred to as a tongue-and-groove joint. Before the frame parts 2–5 are installed to panel 1, various radii 6*a*, 6*b* and chamfers 6*c* are cut into the parts.

The conventional raised panel door has several disadvantages. The door is expensive to manufacture because the several parts must be precisely machined in order to fit properly together. Additionally, once the door is assembled, there is a tendency for the parts of the door to separate as a result of variations in the environment, such as fluctuations in temperature and/or humidity.

It has been proposed to simulate the raised panel door by machining the various shapes from a single sheet of material, such as particle board or a medium density fiberboard. The radii and chamfers of the conventional raised panel door are reproduced in the fiberboard door using various router bits, as shown in FIG. 3. The resulting fabricated door has a similar appearance to the conventional raised panel door. The major disadvantage of this method is the inability to produce a square inside corner. As shown in FIGS. 3 and 4, the router bit used to manufacture the inside surface 6*b* is indicated by numeral 7. Router bit 7 is a cylindrical router bit including a circumferential curved cutting blade 8. It is clear from FIG. 4 that as router bit 7 approaches corner 9, the diameter of router bit 7 prohibits the router bit from cutting a square corner. Instead, the resulting cut includes a curved corner, the radius of which equals the radius of the router bit. This curved corner clearly evidences that the panel is simulated. One can produce the desired square corner by using a router bit which comes to a point. However, this is a long, complex and expensive process.

Accordingly, it is an object of the present invention to provide an improved apparatus for machining an interior square corner on a workpiece.

Another object of the present invention is to provide an improved apparatus for machining an interior square corner having the same appearance as a conventional raised panel door.

Other objects and advantages of the present invention will become more apparent to those persons having ordinary skill in the art to which the present invention pertains from the following description taken in conjunction with the accompanying drawings.

DESCRIPTION OF THE PREFERRED EMBODIMENTS

Figure 1:
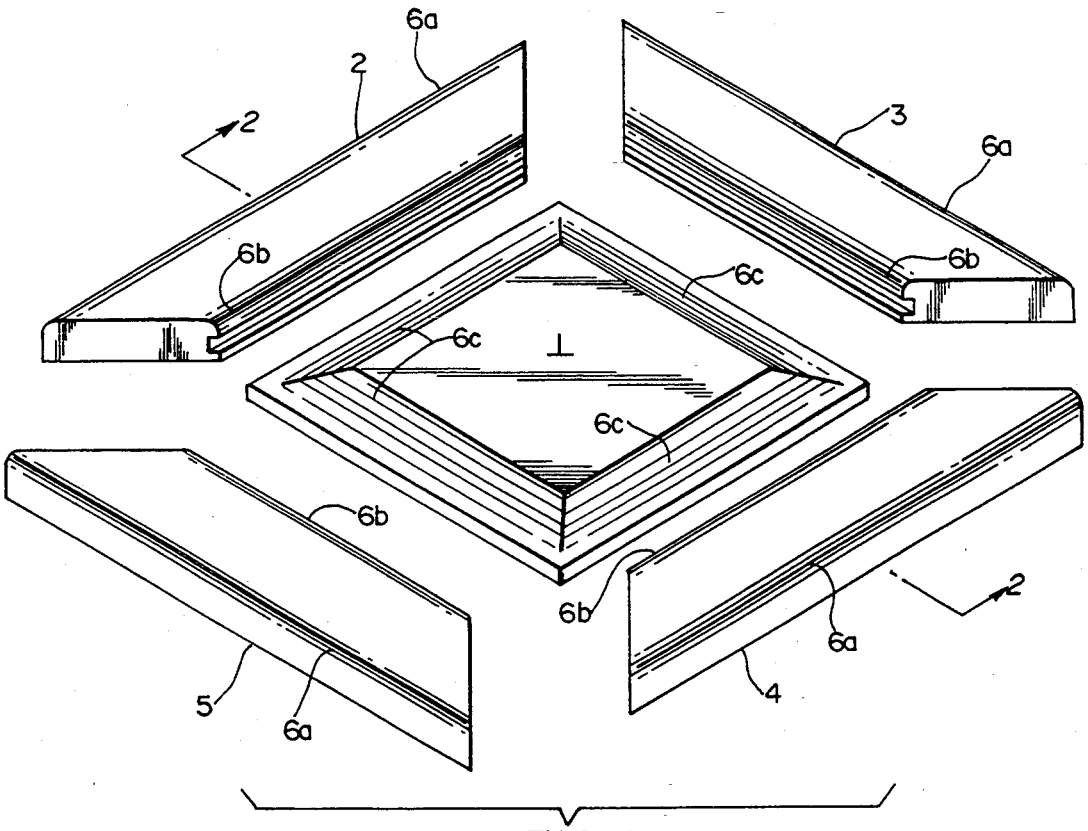
FIG. 1 PRIOR ART
FIG. 1 is an exploded perspective view of the conventional raised panel door.
Figure 2:
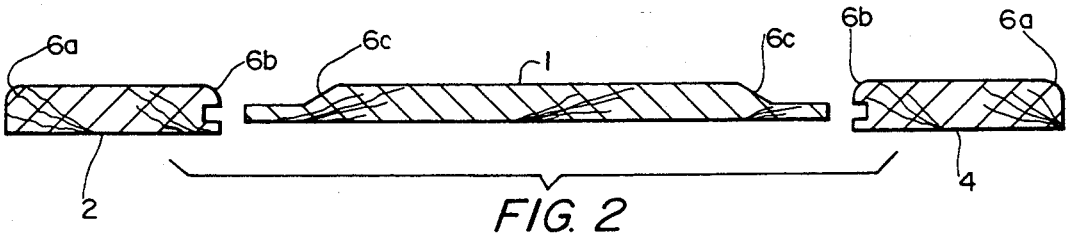
FIG. 2 PRIOR ART
FIG. 2 is a sectional view of the conventional door of FIG. 1, taken along lines 2—2 of FIG. 1.
Figure 3:
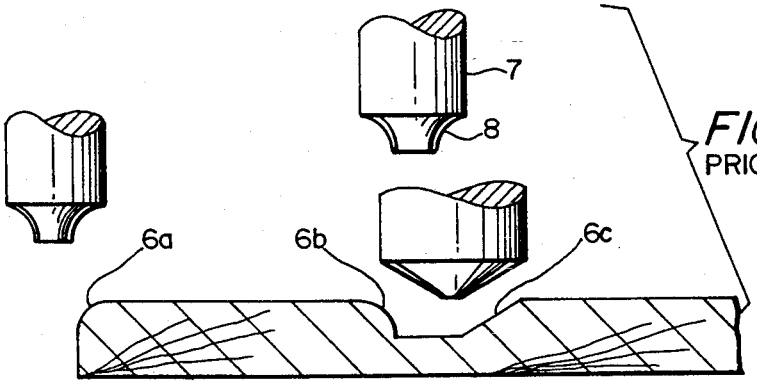
FIG. 3 PRIOR ART
FIG. 3 is a sectional view of a simulated door.
Figure 4:
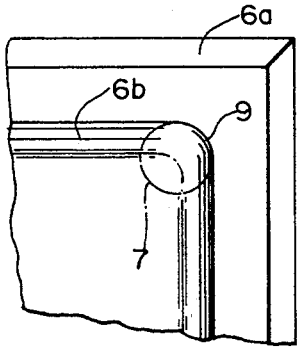
FIG. 4 PRIOR ART
FIG. 4 is a detail view of the simulated door of FIG. 3.
Figure 5:
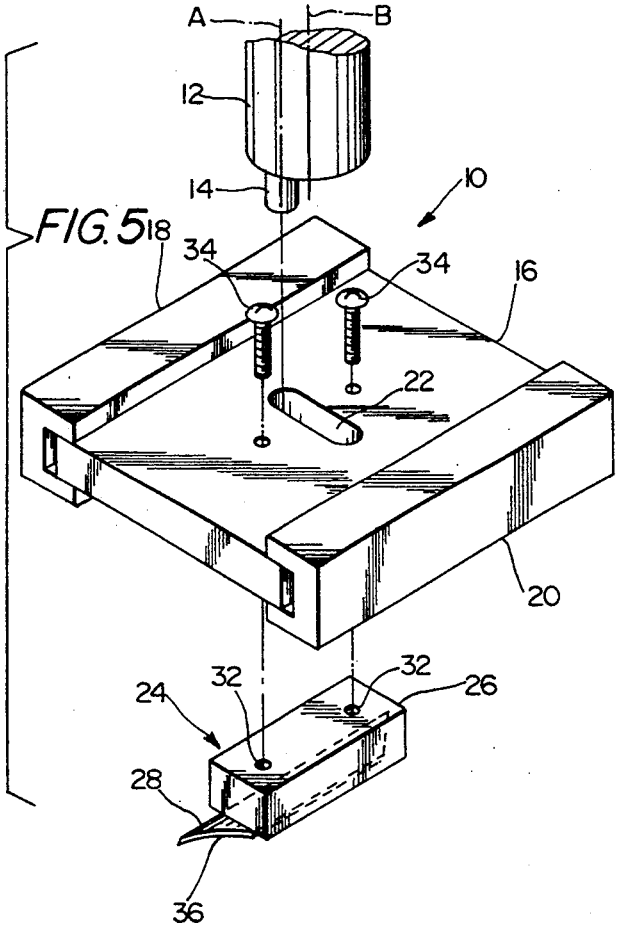
FIG. 5 is an exploded view of the preferred embodiment of the apparatus of the present invention.
Figure 6:
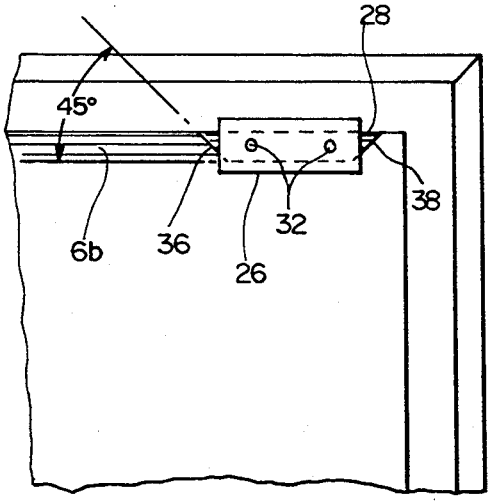
FIG. 6 is a top view of the chisel of FIG. 5 being used to machine a door, with parts of the apparatus omitted for clarity.
Figure 7:
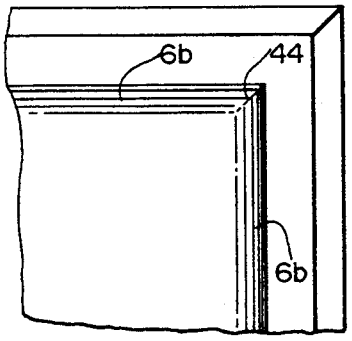
FIG. 7 is a detail view of the resulting door utilizing the embodiment of the invention shown in FIGS. 5 and 6.

Referring to the illustration of the present invention shown in FIGS. 5–7, the apparatus, shown generally as 10, includes a cylindrical shaft 12 and a pin 14 mounted to the end of shaft 12. As seen in FIG. 5, pin 14 includes an axis A—A which is parallel to and offset from an axis B—B of shaft 12.

Apparatus 10 further includes a sliding plate 16 and a pair of sliding sleeves 18 and 20. Sliding plate 16 includes an elongated slot 22 within which pin 14 is received. As shaft 12 rotates about axis B—B, the pin's movement within slot 22 causes sliding plate 16 to oscillate transversely. Sleeves 18 and 20 are disposed on either side of sliding plate 16 to guide the plate in its transverse oscillating motion.

A cutting tool 24 is attached to sliding plate 16 so that cutting tool 24 oscillates transversely with sliding plate 16. Cutting tool 24 includes a support plate 26 and at least one cutting blade 28. Support plate 26 preferably includes two internally threaded holes 32 to receive two screws 34, thereby attaching cutting tool 24 to sliding plate 16.

Cutting blade 28 is shaped to the contour of the inside surface 6*b*. Preferably, the contour of blade 28 is a curved cross-section approximating a quarter circle. However, any desired contour may be utilized. Additionally, cutting blade 28 includes two blade cutting edges 36 and 38. As best seen in FIG. 6, cutting edges 36 and 38 are each disposed at a 45° angle from the longitudinal axis X—X of the cutting tool. Thus, cutting blade 28 will form a cut surface that ends at a 45° angle, as indicated by numeral 44 in FIG. 7.

To form the square corner, the apparatus 10 is placed so that the cutting tool is positioned as shown in FIG. 6. The apparatus operates so that the transverse oscillating motion of the tool is in the direction of the arrows of FIG. 6. The surface 6*b* is cut by the tool up to the corner, where the surface ends at 44 at a 45° angle. By moving the tool to the perpendicular edge and again operating the apparatus up to the corner, a second surface 6*b* is cut, again ending at a 45° angle at 44. The resulting machined surfaces, as shown in FIG. 7, form a square inside corner, simulating the appearance of the true corner of the conventional raised panel door. By rotating the workpiece as necessary, blade 28 with cutting edges 36, 38 enable all four corners of the workpiece to be squared in a similar manner.

From the foregoing detailed description, it will be evident that there are a number of changes, adaptations and modifications of the present invention which come within the province of those having ordinary skill in the art to which the aforementioned invention pertains. However, it is intended that all such variations not departing from the spirit of the invention be considered as within the scope thereof, limited solely by the appended claims.

We claim:

1. An apparatus for machining a square inside corner on the face of a workpiece comprising:

a rotatable shaft including an axis;

means cooperating with said shaft for transferring rotating motion of the shaft to transverse oscillating motion in a direction parallel to the face of the workpiece;

an elongated cutting tool mounted to said transferring means and moving in said transverse oscillating motion parallel to the face of the workpiece, said cutting tool including a longitudinal axis and a blade having a sharp cutting edge disposed at a 45° angle from said longitudinal axis.

2. An apparatus according to claim 1, wherein said blade is contoured to provide a contoured cut.

3. An apparatus according to claim 2, wherein said contour is curved to provide a rounded cut edge.

4. An apparatus according to claim 1, wherein said cutting blade has a circular cross-section.

5. An apparatus according to claim 1, wherein said blade includes a pair of sharp cutting edges at both ends thereof to provide cutting in both directions as the cutting blade oscillates, each of said cutting edges being disposed at a 45° angle from said longitudinal axis.

6. An apparatus according to claim 1, wherein said transferring means comprises:

a pin mounted on said shaft and including an axis, said pin axis being parallel to and offset from said shaft axis;

a sliding plate to which said cutting tool is mounted, said sliding plate including an elongated slot for receiving said pin; and a pair of sliding sleeves on either side of said sliding plate for guiding the sliding plate in said transverse oscillating motion;

wherein the movement of said pin within said slot causes said sliding plate to slide transversely within said pair of sliding sleeves to provide said transverse oscillating motion.

7. An apparatus according to claim 6, further comprising means for securing said cutting tool to said sliding plate.

8. An apparatus according to claim 7, wherein said cutting tool includes a support plate.

9. An apparatus according to claim 8, wherein said support plate includes an internally threaded hole, said securing means comprising a screw received in said hole.

10. An apparatus according to claim 6, wherein said cutting tool blade is contoured to provide a contoured cut.

11. An apparatus according to claim 6, wherein said cutting tool blade includes a pair of sharp cutting edges at both ends thereof, each of said cutting edges being disposed at a 45° angle.

* * * * *